US006105826A

United States Patent [19]

Oursin et al.

[11] Patent Number: 6,105,826

[45] Date of Patent: Aug. 22, 2000

[54] FLUID DISPENSER PROVIDED WITH A DUAL PURPOSE SAFETY DEVICE

[75] Inventors: Dominique Oursin, Elbeuf; Laurent Arghyris, Sotteville-les-Rouen, both of France

[73] Assignee: Valois S.A., Le Neubourg, France

[21] Appl. No.: 09/101,635

[22] PCT Filed: Jan. 8, 1997

[86] PCT No.: PCT/FR97/00034

§ 371 Date: Dec. 10, 1998

§ 102(e) Date: Dec. 10, 1998

[87] PCT Pub. No.: WO97/26203

PCT Pub. Date: Jul. 24, 1997

[30] Foreign Application Priority Data

Jan. 16, 1996 [FR] France ..... 96/00412

[51] Int. Cl.[7] ..... B65D 47/10

[52] U.S. Cl. ..... 222/153.06; 222/153.11; 222/153.13; 222/321.9; 222/402.1; 222/533

[58] Field of Search ..... 222/153.06, 153.11, 222/153.13, 153.14, 321.7, 321.8, 402.1, 527, 528, 533

[56] References Cited

U.S. PATENT DOCUMENTS

| | | | |
|---|---|---|---|
| 3,221,950 | 12/1965 | O'Donnell | 222/394 |
| 3,907,174 | 9/1975 | Steiman | 222/153.13 |
| 4,589,574 | 5/1986 | Foster | 222/153.13 |
| 4,972,974 | 11/1990 | Chavkin et al. | 222/153.13 |
| 5,085,347 | 2/1992 | Hayes et al. | 222/153.13 |
| 5,855,304 | 1/1999 | Dean et al. | 222/533 |
| 5,890,631 | 4/1999 | Spurlock et al. | 222/527 |

FOREIGN PATENT DOCUMENTS

| | | | |
|---|---|---|---|
| 2 088 275 | 1/1972 | France . | |
| 2238088 | 5/1991 | United Kingdom | 222/153.13 |

*Primary Examiner*—Joseph A. Kaufman
*Attorney, Agent, or Firm*—Sughrue, Mion, Zinn, Macpeak & Seas, PLLC

[57] ABSTRACT

A fluid dispenser includes a receptacle (1), a dispenser member (2), and an actuator member (10) for actuating the dispenser member (2) to dispense the fluid selectively. The actuator member (10) is movable between a rest position and an actuation position for actuating the dispenser member (2), and includes a body portion (11) and a fluid expulsion portion (12) provided with an outlet orifice (13), the fluid expulsion portion (12) being movable relative to the body portion (11) between a locking position in which it prevents the actuator member (10) from moving towards its actuation position, and an in-use position in which it allows the actuator member (10) to move towards its actuation position. The fluid expulsion portion (12) includes a tongue (14) which, in the locking position, co-operates with a fixing element that is fixed relative to the receptacle (1), co-operation taking place through a slot (15) formed in the body portion (11), the slot (15) including, before first use of the dispenser, at least one bridge of material (16) acting as a first-use safety device and adapted to break when the fluid expulsion portion (12) is moved for the first time from its locking position to its in-use position.

12 Claims, 5 Drawing Sheets

FLUID DISPENSER PROVIDED WITH A DUAL PURPOSE SAFETY DEVICE

BACKGROUND OF THE INVENTION

The present invention relates to a fluid dispenser provided with a dual-purpose safety device, and in particular a fluid dispenser having a safety device providing safety both in transport and in first-use.

The term "transport safety" is used to refer to a device which prevents untimely or accidental actuation of the dispenser, particularly while it is being transported. The term "first-use safety" is used to refer to a device which informs the user whether the fluid dispenser has already been used for the first time.

Transport safety devices for fluid dispensers are well known in the state of the art. In particular, U.S. Pat. Nos. 3,148,806 and 3,402,862 disclose transport safety devices in which actuation of the dispenser is prevented by pivoting a portion of the pushbutton into a locking position, and to actuate the dispenser, it is necessary for said pushbutton to be pivoted back into its unlocking position. In the locking position, a portion of the pushbutton bears against a fixed element of the dispenser, thereby preventing any actuation of said pushbutton. When the pushbutton is moved into its unlocking position, it no longer co-operates with said fixed element of the dispenser and the pushbutton can be actuated to dispense the fluid.

First-use safety devices, also referred to as "guarantee", devices, are also known in the state of the art. For example, document FR-2 697 505 discloses the use of an external ring placed around the actuator member of the dispenser, said ring including a tongue that must be torn off before first use of the dispenser, with the external ring being removable once the tongue has been torn off, thereby enabling the dispenser to be actuated.

Those two distinct devices nevertheless give rise to complication in the manufacture and the assembly of dispensers, and they therefore increase cost.

SUMMARY OF THE INVENTION

An object of the present invention is to provide a fluid dispenser having a safety device both for transport and for first use. With known dispensers, combining both kinds of safety measures implies using two distinct safety devices, one providing transport safety and the other first-use safety. Manufacture and assembly of such a dispenser is consequently more complicated, thus implying a higher cost.

An object of the present invention is to overcome the drawback and to provide a fluid dispenser which advantageously combines both types of safety measures in a single device, so as to simplify manufacture and assembly and thus reduce cost.

The present invention thus provides a fluid dispenser comprising a receptacle, a dispenser member, and an actuator member for actuating the dispenser member to dispense said fluid selectively, said actuator member being movable between a rest position and an actuation position for actuating the dispenser member, and including a body portion and a fluid expulsion portion provided with an outlet orifice, said fluid expulsion portion being movable relative to said body portion between a locking position in which it prevents the actuator member moving towards its actuation position, and an in-use position in which it allows the actuator member to move towards its actuation position, said fluid expulsion portion including a tongue which, in the locking position, co-operates with a fixing element that is fixed relative to the receptacle, co-operation taking place through a slot formed in said body portion, said slot including, before first use of the dispenser, at least one bridge of material acting as a first-use safety device and adapted to break when said fluid expulsion portion is moved for the first time from its locking position to its in-use position.

Preferably, the fluid expulsion portion is movable relative to said body portion in rotation about an axis perpendicular to the direction in which said actuator member is movable, said fluid expulsion portion in its locking position extending substantially parallel to said direction in which the actuator member is movable, and in its in-use position extending substantially perpendicularly to said direction in which the actuator member is movable.

In a first embodiment of the invention, said slot extends on either side of the tongue when the fluid expulsion portion is in its locking position, such that said fluid expulsion portion can be moved in either direction towards its in-use position.

Advantageously, prior to first use of the dispenser, said slot incorporates a breakable bridge of material on either of said tongue.

In a second embodiment of the invention, said slot extends to one side only of the tongue when the fluid expulsion portion is in its locking position, said slot incorporating, prior to first use of the dispenser, a breakable bridge of material on said side.

Preferably, the dispenser member is mounted in fixed manner on said receptacle by means of a fixing element, and when said fluid expulsion portion is in its locking position, said tongue co-operates with said fixing element to prevent the actuator member moving towards its actuation position.

Advantageously, said body portion includes an abutment member which co-operates with the fluid expulsion portion when said portion is in its in-use position.

In particular, the fluid expulsion portion includes a rib which, in the in-use position, co-operates with a flat secured to said body portion to lock said fluid expulsion portion in the in-use position.

In an advantageous embodiment, said dispenser member is a pump, said fixing element is a fixing ring, and said actuator member is a pushbutton that is axially movable on said pump and around said ring.

In another advantageous embodiment, said dispenser member is a valve, said fixing element is a fixing ring, and said actuator member is a pushbutton.

Advantageously, said pushbutton is angularly movable and includes two internal ribs bearing against the ring and co-operating with the tongue to prevent the pushbutton being actuated while the fluid expulsion portion is in the locking position.

Advantageously, said fluid expulsion portion of the actuator member includes a nozzle.

BRIEF DESCRIPTION OF THE DRAWINGS

Other characteristics and advantages of the present invention appear on reading the following detailed description given by way of non-limiting example with reference to the accompanying drawings, in which.

DETAILED DESCRIPTION OF THE PREFERRED EMBODIMENTS

Figure 1:
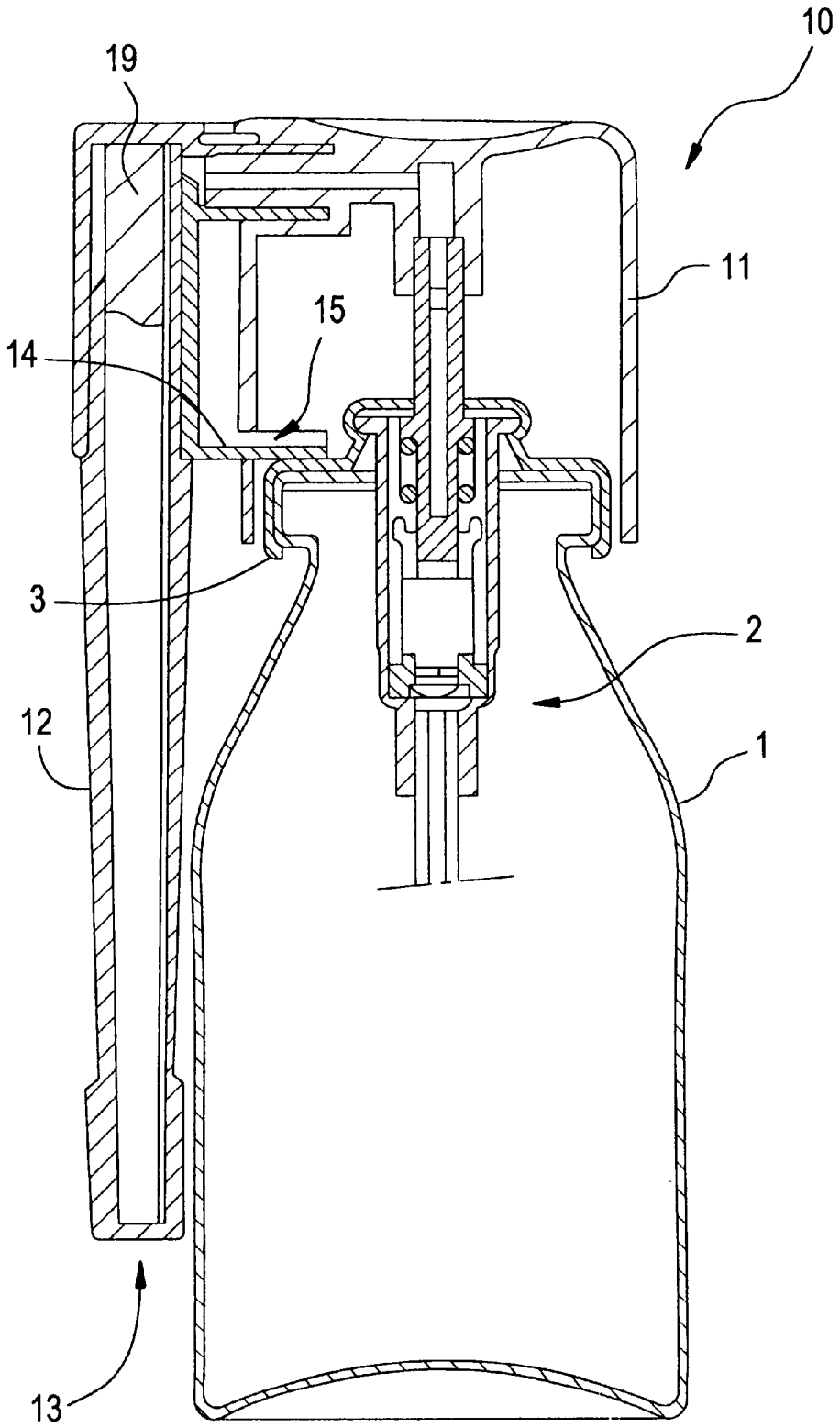
FIG. 1 is a diagrammatic section view of a fluid dispenser of the invention.

With reference to FIG. 1, a fluid dispenser of the invention comprises a receptacle 1 having an opening in which there is mounted a dispenser member 2, advantageously by means of a fixing element 3. The dispenser member 2 can be of any kind, and in particular it may comprise a pump or a valve. Similarly, the fixing element 3 may be a ring for screw-fastening or snap-fastening, a cup, or any other fixing element appropriate for fixing a dispenser member on a receptacle. The fluid dispenser is actuated by means of an actuator member 10 which is advantageously a pushbutton.

Figure 2:
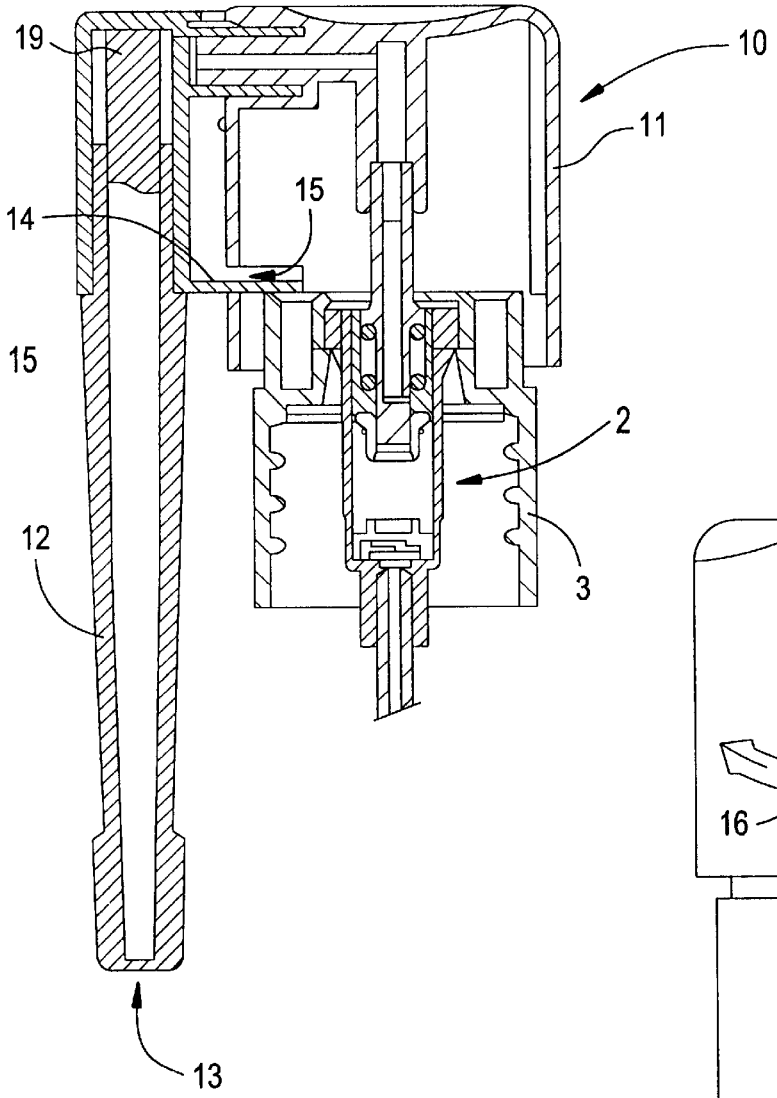
FIG. 2 is a fragmentary diagrammatic section view of a variant embodiment of a fluid dispenser of the invention.

In accordance with the invention, this actuator member (or pushbutton) 10 comprises a body portion 11 and a fluid expulsion portion 12. It is movable, for example in translation if a pump is being used, between a rest position and a position in which the dispenser member 2 is actuated. The expulsion portion 12 is provided with an outlet orifice 13 and advantageously with a nozzle 19, and it is movable relative to the body portion 11 between a locking position where it prevents the pushbutton 10 from moving into its actuation position, and an in-use position where it allows the pushbutton 10 to be moved into its actuation position. FIG. 1 shows more particularly the locking position of the fluid expulsion portion 12 of the pushbutton 10. This fluid expulsion portion 12 has a projecting portion such as a tongue 14 which co-operates, in the locking position, with a fixing element 3 that is fixed relative to the receptacle 1 to prevent the pushbutton 10 being moved. Advantageously, said tongue 14 bears against a portion of said fixing element 3 as can be seen in FIGS. 1 and 2, when the dispenser member 2 is directly mounted in the receptacle without using a fixing element 3, the tongue can co-operate either with the receptacle 1 or with a portion of the pump body. To co-operate with the fixing element 3 that is fixed relative to the receptacle, the tongue 14 of the fluid expulsion portion 12 extends through a slot 15 formed in said body 11 of the pushbutton 10.

Figure 4:
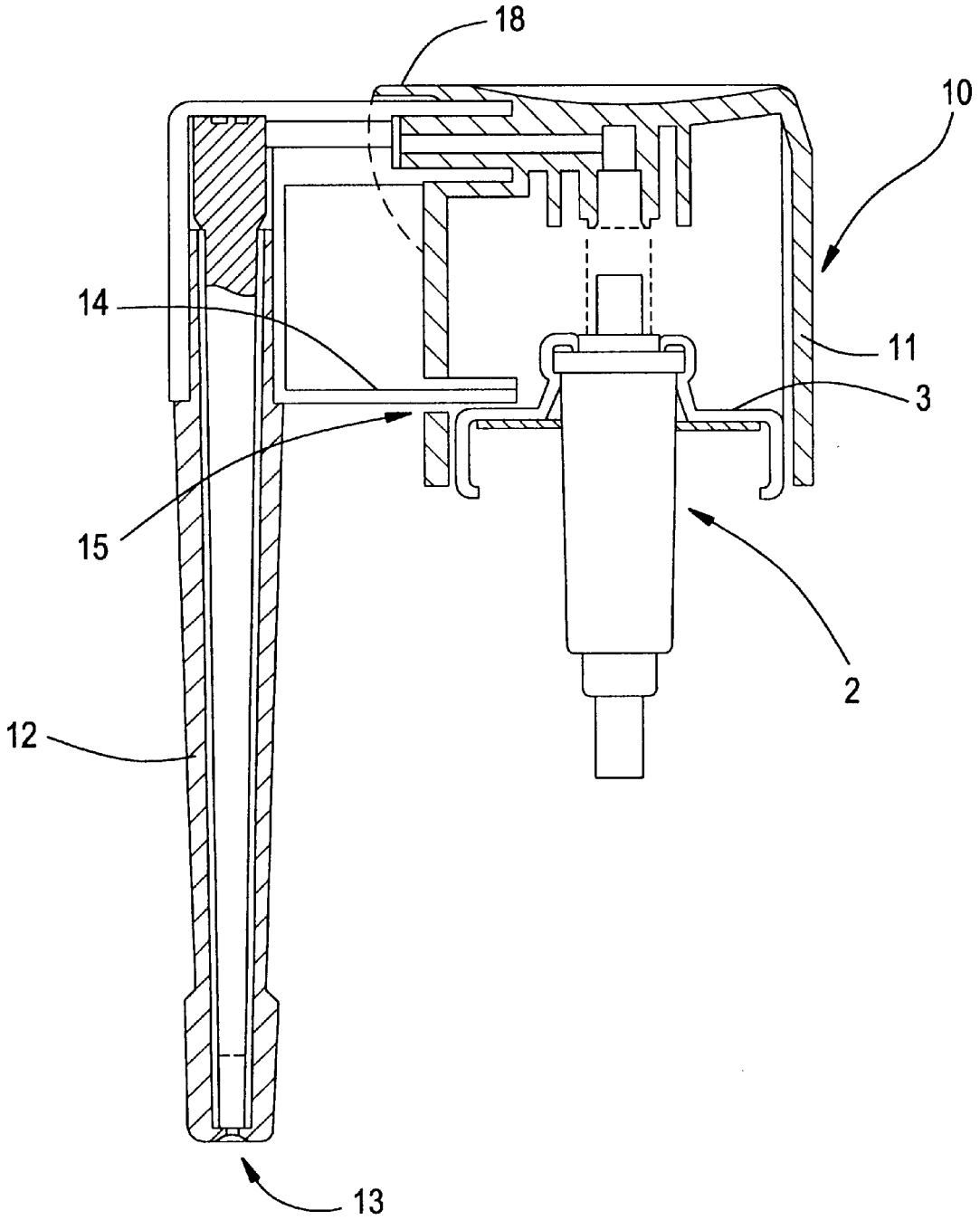
FIG. 4 is a view similar to FIG. 2 and shows another variant embodiment of the invention.
Figure 4A:
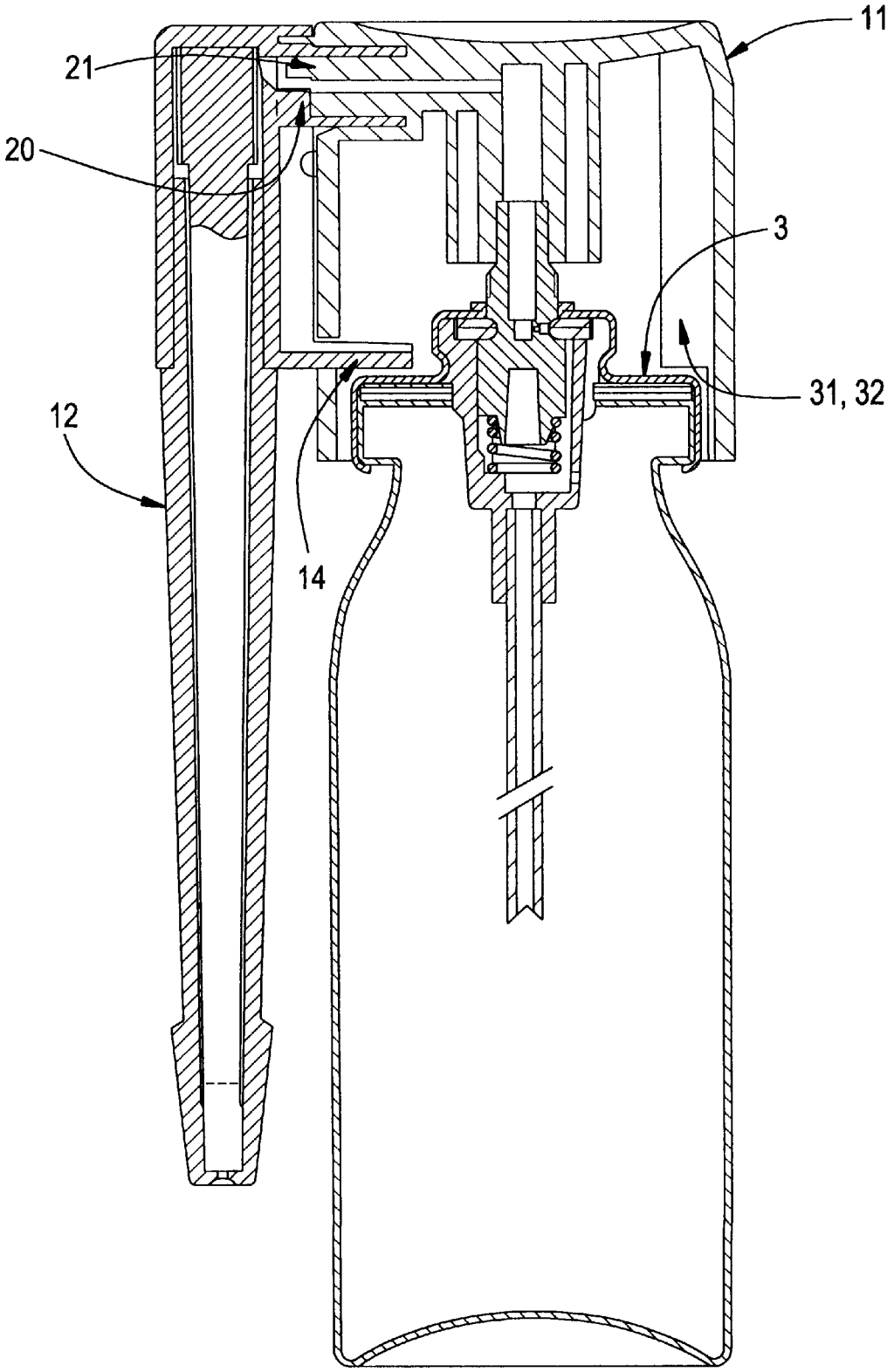
FIG. 4*a* is a view similar to FIG. 1 showing yet another variant embodiment of the invention.
Figure 5:
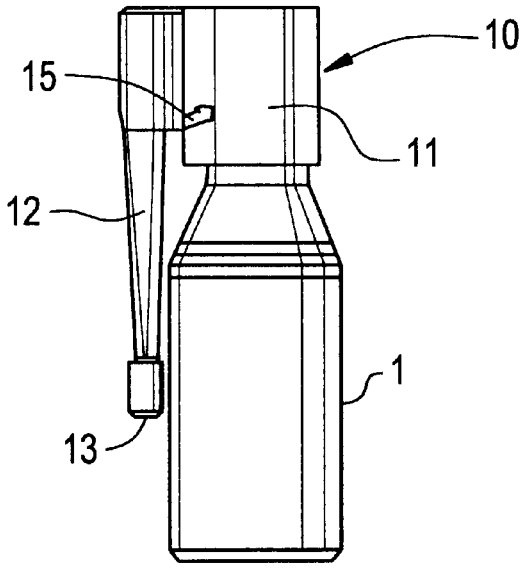
FIG. 5 a diagrammatic overall view showing a dispenser of the present invention in its locking position.
Figure 6:
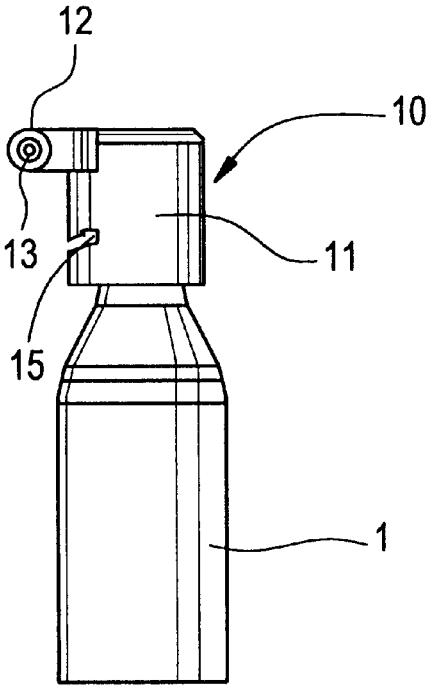
FIG. 6 is a view similar to that of FIG. 5 with the dispenser in its in-use position.

Said fluid expulsion portion 12 is preferably moved relative to said body portion 11 of the pushbutton 10 by rotating about an axis that is perpendicular to the direction in which the pushbutton moves. In the example shown in the figures, the pushbutton 10 moves vertically in translation and the fluid expulsion portion 12 turns about a horizontal axis. Thus, in its locking position, the expulsion portion 12 is substantially parallel to said direction in which the actuator member 10 is moved, and in its in-use position, said expulsion portion 12 is substantially perpendicular to said direction in which the actuator member 10 moves. Advantageously, an abutment member 18, 21 can be provided on the body portion 11 of the pushbutton 10 as shown in FIG. 4. By way of example, this abutment member may be a flange 18 extending over the fluid expulsion portion 12 and co-operating therewith when it is in its in-use position. In this way, the maximum angle through which the fluid expulsion portion 12 can be rotated is preferably ±90° relative to the locking position, and can be determined by said abutment member 18. Another example of an abutment member is shown in FIG. 4*a*. In this example, the fluid expulsion portion 12 has a rib 20 which co-operates with a flat 21 secured to the body portion 11 to lock said fluid expulsion portion in the in-use position.

Figure 3:
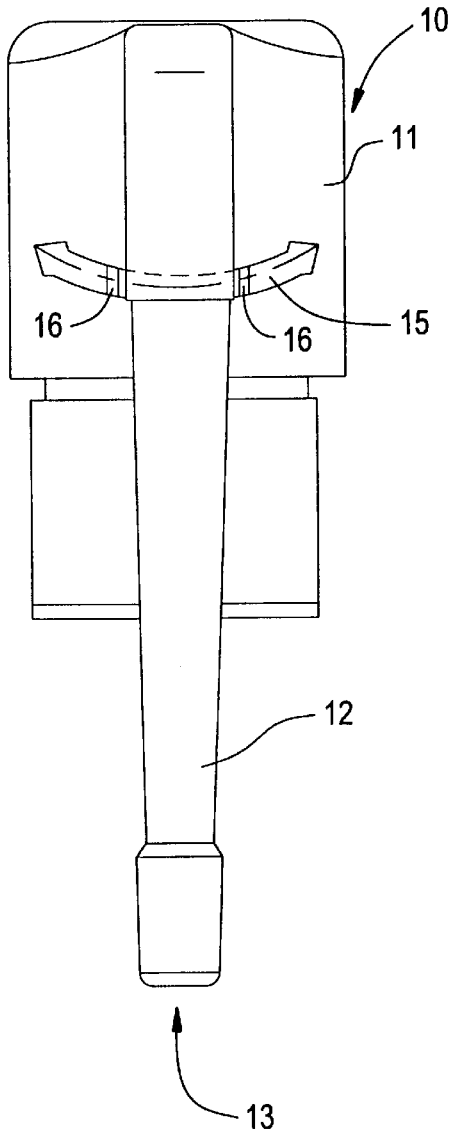
FIG. 3 is fragmentary diagrammatic elevation view showing more particularly the first use safety device of the present invention.

Because of this rotary movement of the fluid expulsion portion 12 relative to the body portion 11, said slot 15 is preferably slightly curved in shape, as can be seen in FIG. 3, thereby enabling the tongue 14 to move in rotation in the slot 15 between the locking position and the in-use position.

Figure 7:
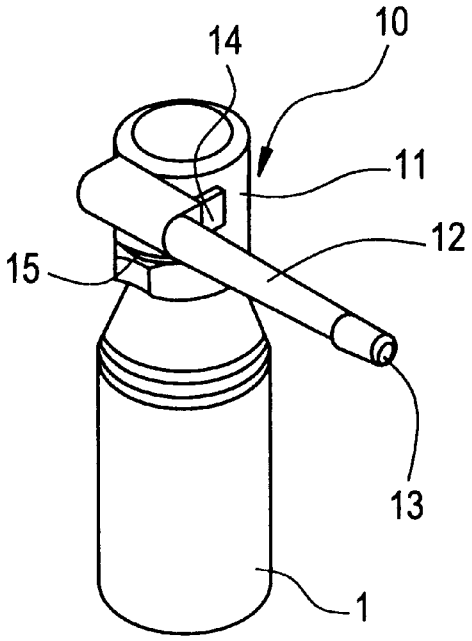
FIG. 7 is a diagrammatic perspective view of a dispenser of the invention in its in-use position.

As can be seen in FIGS. 1 and 2, the tongue 14, when in its locking position, bears against the fixing element 3 of the dispenser member 2, so that actuation of the pushbutton 10 is prevented. When the expulsion portion 12 is moved towards its in-use position, the tongue 14 slides in the slot 15 until it no longer co-operates with the fixing element 3 and it occupies the position shown in FIG. 7, outside the body portion 11. In this in-use position, the pushbutton 10 can be actuated to dispense the fluid.

According to the invention, the slot 15 formed in the body portion 11 of the pushbutton 10 incorporates a first-use safety device, also known as a "guarantee" device or a "first-use indicator" device. This device is preferably constituted by at least one bridge of material 16 that is suitable for breaking when the fluid expulsion portion 12 is moved for the first time from its locking position to its in-use position. In this way, if the bridge of material 16 is intact, the user knows that the dispenser has never been actuated. This breakable bridge of material can be made of any suitable material such as a plastics material, and is advantageously integrally formed with the body portion 11 of the pushbutton 10.

As shown more particularly in FIG. 3, in the locking position, the slot 15 can extend on either side of the expulsion portion 12 such that the expulsion portion can be moved in either direction away from the locking position to an in-use position. In this embodiment, the slot 15 consequently preferably has two bridges of material 16, one on either side of the tongue 14, such that the first-use safety device is effective in both directions. Naturally, the slot 15 could equally well extend in one direction only from the locking position of the fluid expulsion portion 12, in which case only one bridge of material needs to be provided on said side.

As mentioned above, the dispenser member 2 may be a valve (see FIG. 4*a*). In some cases, the valve can be triggered even if the pushbutton 10 is not moved axially, but is only moved angularly. Under such circumstances, it is advantageous to provide one or more internal ribs 31, 32 (preferably two such ribs) inside the pushbutton 10 to bear against the fixing ring 3. Thus, when the fluid expulsion portion 12 is in the locking position, the two ribs 31 and 32 co-operate with the tongue 14 to form three-point contact preventing any axial and/or angular displacement of the pushbutton 10. When the fluid expulsion portion 12 is moved towards its in-use position, it becomes possible to displace the pushbutton angularly, since contact between the pushbutton 10 and the ring 3 takes place only via two points. Advantageously, the ribs 31 and 32 are disposed in such a manner as to co-operate with the tongue 14 to form a triangle that is approximately equilateral.

The dispenser of the invention thus makes it possible to provide both desired kinds of safety measures, i.e., transport safety which prevents the dispenser from being actuated so long as it is in the locking position, and first-use safety for informing the user whether the dispenser has been used previously. Both safety measures in the dispenser of the invention are implemented by the same means, specifically the slot 15 co-operating with the tongue 14. The invention thus provides the advantage of making it possible to make a dispenser including both kinds of safety measure with a minimum of complication in manufacture and assembly, and therefore at minimum cost. In addition, as explained above, the device of the invention is easily applied to any type of receptacle, to any type of dispenser member, and to any type of fixing element.

What is claimed is:

1. A fluid dispenser comprising a receptacle (1), a dispenser member (2), and an actuator member (10) for actuating the dispenser member (2) to dispense a fluid selectively, said actuator member (10) being movable between a rest position and an actuation position for actuating the dispenser member (2), and including a body portion (11) and a fluid expulsion portion (12) provided with an outlet orifice (13), said fluid expulsion portion (12) being movable relative to said body portion (11) between a locking position in which said fluid expulsion portion prevents the actuator member (10) from moving towards an actuation position, and an in-use position in which said fluid expulsion portion allows the actuator member (10) to move towards the actuation position, the dispenser being characterized in that said fluid expulsion portion (12) includes a tongue (14) which, in the locking position, co-operates with a fixing element that is fixed relative to the receptacle (1), co-operation taking place through a slot (15) formed in said body portion (11), said slot (15) including, before first use of the dispenser, at least one bridge of material (16) acting as a first-use safety device and adapted to break when said fluid expulsion portion (12) is moved for the first time from the locking position to the in-use position.

2. A dispenser according to claim 1, in which the fluid expulsion portion (12) is movable relative to said body portion (11) in rotation about an axis perpendicular to the direction in which said actuator member (10) is movable, said fluid expulsion portion (12) in the locking position extending substantially parallel to said direction in which the actuator member (10) is movable, and in the in-use position extending substantially perpendicularly to said direction in which the actuator member (10) is movable.

3. A dispenser according to claim 1, in which said lot (15) extends on either side of the tongue (14) when the fluid expulsion portion (12) is in the locking position, such that said fluid expulsion portion (12) can be moved in either direction towards the in-use position.

4. A dispenser according to claim 3, in which, prior to first use of the dispenser, said slot (15) incorporates a breakable bridge of material (16) on either side of said tongue (14).

5. A dispenser according claim 1, in which said slot (15) extends to one side only of the tongue (14) when the fluid expulsion portion (12) is in the locking position, said slot (15) incorporating, prior to first use of the dispenser, a breakable bridge of material (16) on said side.

6. A dispenser according to claim 1, in which the dispenser member (2) is mounted in fixed manner on said receptacle (1) by means of said fixing element, and when said fluid expulsion portion (12) is in the locking position, said tongue (14) co-operates with said fixing element to prevent the actuator member (10) from moving towards its actuation position.

7. A dispenser according to claim 1, in which said body portion (11) includes an abutment member (18) which co-operates with the fluid expulsion portion (12) when said fluid expulsion portion is in the in-use position.

8. A dispenser according to claim 7, in which the fluid expulsion portion (12) includes a rib (20) which, in the in-use position, co-operates with a flat (21) secured to said body portion (11) to lock said fluid expulsion portion in the in-use position.

9. A dispenser according to claim 6, in which said dispenser member (2) comprises a pump, said fixing element comprises a fixing ring (3), and said actuator member (10) comprises a pushbutton that is axially movable on said pump (2) and around said fixing ring (3).

10. A dispenser according to claim 6, in which said dispenser member (2) comprises a valve, said fixing element comprises a fixing ring (3), and said actuator member (10) comprises a pushbutton.

11. A dispenser according to claim 10, in which said pushbutton (10) is angularly movable and includes two internal ribs (30, 31) bearing against the fixing ring (3) and co-operating with the tongue (14) to prevent the pushbutton (10) from being actuated while the fluid expulsion portion (12) is in the locking position.

12. A dispenser according to claim 1, in which said fluid expulsion portion (12) of the actuator member (10) includes a nozzle (19).

* * * * *